US010569945B2

(12) United States Patent
Gupta

(10) Patent No.: US 10,569,945 B2
(45) Date of Patent: Feb. 25, 2020

(54) MULTIFUNCTIONAL INSULATING SLEEVE WITH CLASP MECHANISM

(71) Applicant: Design By Freedom, LLC, South Riding, VA (US)

(72) Inventor: Anukampa Gupta, South Riding, VA (US)

(73) Assignee: Design By Freedom, LLC, South Riding, VA (US)

( * ) Notice: Subject to any disclaimer, the term of this patent is extended or adjusted under 35 U.S.C. 154(b) by 0 days.

(21) Appl. No.: 15/977,395

(22) Filed: May 11, 2018

(65) Prior Publication Data

US 2018/0327156 A1 Nov. 15, 2018

Related U.S. Application Data

(60) Provisional application No. 62/506,097, filed on May 15, 2017.

(51) Int. Cl.
*B65D 63/10* (2006.01)
*B65D 81/38* (2006.01)

(52) U.S. Cl.
CPC ..... *B65D 63/1018* (2013.01); *B65D 81/3876* (2013.01); *B65D 63/109* (2013.01); *B65D 2563/107* (2013.01)

(58) Field of Classification Search
CPC ..... B65D 63/1018; B65D 63/1027; B65D 63/109; B65D 81/3876; Y10S 220/903; Y10T 24/1498; Y10T 24/15; Y10T 24/3924; Y10T 24/3929; Y10T 24/398
See application file for complete search history.

(56) References Cited

U.S. PATENT DOCUMENTS 2,974,916 A * 3/1961 Richey ..... F16L 3/1236 24/302
5,259,529 A 11/1993 Coale
5,857,615 A 1/1999 Rose
(Continued)

FOREIGN PATENT DOCUMENTS

WO 2014006420 A1 1/2014

OTHER PUBLICATIONS

International Search Report and Written Opinion for co-pending PCT App. No. PCTUS2018/032328 dated Jul. 23, 2018

*Primary Examiner* — Robert Sandy
(74) *Attorney, Agent, or Firm* — D'Ambrosio & Menon, PLLC; Usha Menon

(57) ABSTRACT

A sleeve for an object is disclosed. In an open configuration, the sleeve is an elongate strip having an inner wall surface and an outer opposed wall surface. The inner and outer wall surfaces can be textured. The inner wall surface is configured to contact the object. The strip includes a clasp mechanism. The clasp mechanism can include at least one protrusion extending radially outward from the outer wall surface. The protrusion can be located at a proximal marginal end of the outer wall surface. The class mechanism can further include at least one indented receptacle located at a distal marginal end of the outer wall surface. The receptacle can extend between the inner and outer wall surfaces. In a closed configuration, the receptacle can be adapted to securably receive and restrain the protrusion therein. In the closed configuration, the strip forms a band around a circumference of the object.

17 Claims, 5 Drawing Sheets

(56) References Cited

U.S. PATENT DOCUMENTS

| | | | | |
|---|---|---|---|---|
| 6,073,315 | A * | 6/2000 | Rasmussen | B65D 63/1018 24/16 PB |
| 6,523,229 | B2 * | 2/2003 | Severson | B65D 63/1018 24/16 PB |
| D597,795 | S | 8/2009 | Ford | |
| D640,508 | S | 6/2011 | Bouillon | |
| 8,365,947 | B2 | 2/2013 | Solomon | |
| 10,112,755 | B1 * | 10/2018 | Cressy | B65D 63/1027 |
| 2008/0041864 | A1 | 2/2008 | Wong | |
| 2010/0219195 | A1 | 9/2010 | Cook et al. | |

* cited by examiner

MULTIFUNCTIONAL INSULATING SLEEVE WITH CLASP MECHANISM

CROSS-REFERENCE TO RELATED APPLICATION

This application claims priority to, and claims benefit from U.S. Provisional Application Ser. No. 62/506,097, filed on May 15, 2017, and titled "MULTIFUNCTIONAL INSULATING SLEEVE WITH CLASP MECHANISM," which is hereby incorporated herein by reference in its entirety.

TECHNICAL FIELD

The present invention generally relates to the sleeves for an object. In particular, the present invention is directed to a sleeve for a beverage container.

BACKGROUND

Background description includes information that may be useful in understanding the present invention. It is not an admission that any of the information provided herein is prior art or relevant to the presently claimed invention, or that any publication specifically or implicitly referenced is prior art.

Insulating sleeves for protection from hot beverage cups are a ubiquitous feature in almost all western concept coffee shops, baristas, and drive through establishments worldwide. Typically, such sleeves are used for protecting the user hands from the hot contents of the cup, but can also be equally effectively used for cold beverages.

The sleeves are generally for disposable and good for single use. They are made of paper, such as corrugated paper, or may be made of plastic. Such sleeves may not be biodegradable, and in any case, contribute to high volume environmental pollution and waste generation. Secondly, such sleeves have no secondary use. Further, there is no standardization of sleeves across industries, thus forcing customers to keep using different sleeves for different functions. Lastly, all sleeves available in the market are non-descript and unimaginative.

An environmentally conscious or a savvy customer, thus, has no alternative available where he or she can avail of a sleeve that is environmentally friendly and is multipurpose. Therefore, there is a need in the art to provide a sleeve that can have multiple functions such as to appeal to a customer, while at the same time being durable enough for multiple uses and function, and be environmentally safe.

SUMMARY OF THE INVENTION

According to an embodiment, a sleeve for an object is disclosed. In an open configuration, the sleeve can include an elongate strip having an inner wall surface and an outer opposed wall surface. The inner and outer wall surfaces can be textured. The inner wall surface is configured to contact the object. The strip includes a clasp mechanism. The clasp mechanism can include at least one protrusion extending radially outward from the outer wall surface. The protrusion can be located at a proximal marginal end of the outer wall surface. The class mechanism can further include at least one indented receptacle located at a distal marginal end of the outer wall surface. The receptacle can extend between the inner and outer wall surfaces. In a closed configuration, the receptacle can be adapted to securably receive and restrain the protrusion therein. In the closed configuration, the strip forms a band around a circumference of the object.

The protrusion can have any suitable shape. For instance, the shape of the protrusion is selected from a group consisting of a circle, an oval, a square and a rectangle. In one embodiment, the protrusion is a circular ring. The shape of the receptacle is complementary in shape to the protrusion.

An upper surface of the protrusion has a lip portion. In the closed configuration, the lip portion of the protrusion extends outwardly from within the receptacle.

The protrusion can include a central opening. The opening can extend between the inner and outer wall surfaces.

The receptacle can be a cut out that extends between the inner and outer wall surfaces.

The strip can further include a plurality of secondary cut outs. Each of the secondary cut outs can extend between the inner and outer wall surfaces. Each of the secondary cut outs can be spaced at a pre-determined distance between the protrusion and the receptacle.

The secondary cut outs can be selected from a group consisting of logos, letters, numbers, geometric shapes, patterns, cartoon images, animal images, bird images and human images. At least one pair of the secondary cut outs is a mirror image of each other. At least one secondary cut out can be positioned on either side of a central axis that divides the strip into two equally-sized halves.

The sleeve may further include one or more images. For example, the image can be a logo or design element, letters, words, numbers, a pattern, a cartoon image or any other suitable image. The sleeve may be configured to further include a quick response (QR) code or another image, text data or information to facilitate short distance communication with a QR code reader, a radio frequency identification (RFID) communicator, a near field communication (NFC) communicator, and an image sensor.

In one aspect, the object is a beverage container and the sleeve is a beverage sleeve. In particular, the beverage sleeve can provide a multi-utility reusable and environmentally friendly insulating sleeve, which is also user interactive. The sleeve can fit multiple cup sizes. For instance, the sleeve is configured to be folded inside out and outside in such that it can beverage containers of various cup sizes. The sleeve can be a biodegradable, reusable and insulating sleeve. The sleeve can be configured to be substantially completely compostable. In one aspect, the sleeve is made of a recycled material. In one aspect, the sleeve is made of a polymeric resin material comprising: a starch component; a plasticizer; a thermoplastic polyester based resin; and an albumin.

In another aspect, the object is a cord and the sleeve is a cord/wire organizer. The sleeve can, therefore, serve multiple functions. The sleeve can also function as a keychain, a bag tag or hand band.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

BRIEF DESCRIPTION OF THE DRAWINGS

The following drawings form part of the present specification and are included to further illustrate aspects of the present disclosure. The disclosure may be better understood by reference to the drawings in combination with the detailed description of the specific embodiments presented herein.

DETAILED DESCRIPTION OF THE INVENTION

Figure 1A:
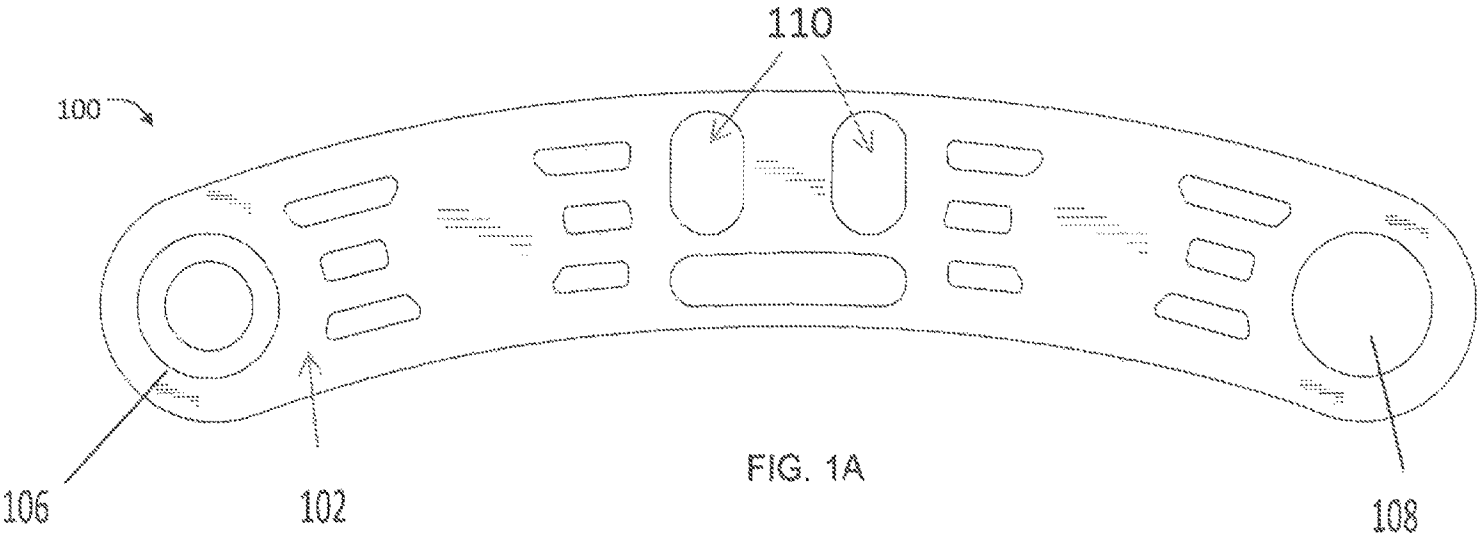
FIGS. 1A and 1B illustrate front and back side views of a sleeve with cut outs that are user interactive in accordance with an embodiment.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The term "protrusion" used in the context of the present invention is meant to mean a raised structure/shape from the general surface. The term "indented receptacle" or "receptacle" means a depression from the general surface. The context of the term will be understood from the adjoining words and sentences of the present invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description.

In an aspect, the present disclosure relates to a multifunctional insulating sleeve that is biodegradable, reusable, poor conductor of temperature differences between inner and outer wall of the sleeve, is in strip form, and has a clasp mechanism for transforming the strip sleeve into a circular sleeve. In an aspect, the sleeve is capable of being substantially composted in about 3-6 months. In another aspect, the clasp mechanism can include a protrusion at one end of the sleeve, and an indented receptacle at the other end of the sleeve, wherein the receptacle can engage the protrusion to transform the strip into a circular sleeve. In an embodiment, the sleeve may include a plurality of protrusions and receptacles for a more secure fit.

The clasp mechanism can include a raised circular protrusion at one end of the sleeve, and an indented receptacle that can be cut out of the sleeve at the other end. The receptacle can be complementary in shape to the raised circular protrusion.

The protrusion can be of a particular height and can be a circular ring of a certain width with an inner and outer circumference. The receptacle circumference can be substantially the same as the outer circumference of the raised circular indent.

The sleeve is configured for insulating the user's hand while holding the sidewall of a hot or cold beverage cup. The sleeve can also function as a wire organizer, a keychain, a bag tag, or a hand/wrist band.

The inner and outer walls of the sleeve are textured.

The sleeve further comprises a plurality of secondary cut outs. These secondary cut outs can be user interactive.

With reference to the FIGURES, there is provided a multifunctional insulating sleeve 100 that is biodegradable, reusable, can used multiple times, can be used for days, weeks, months, and even years. In an embodiment, the sleeve 100 is a poor conductor of temperature differences between the inner and outer wall surfaces of the sleeve. The insulating feature allows the sleeve to be used by the user to comfortably and safely hold hot or cold beverages, particularly hot beverages, such as hot coffee in paper or paper derived cups. Sleeves made of other material which are not insulators are also well within the scope of the present invention. In an embodiment, the proposed sleeve can be in a strip form when unassembled, or in an open configuration. The sleeve includes a clasp mechanism for transforming the strip sleeve (as shown in FIG. 1) into a closed configuration. In the closed configuration, the strip forms a circular band (as shown in FIG. 2).

The sleeve is substantially composted in about 3-6 months. In a preferred embodiment, the sleeve is 100% compostable and can be composted, for instance, in a home setting compost system. In an embodiment of the present invention, the sleeve is made of a fully compostable material. It can also be made of recycled materials such as paper, plastic. It can also be made of elastomers such as silicone rubber. It is contemplated that the material used for construction of the sleeve can be a combination of biodegradable, compostable, or recycled materials. In a preferred embodiment, the sleeve is made of a polymeric resin material comprising a starch component, a plasticizer, a thermoplastic polyester based resin, and albumin.

The clasp mechanism comprises a protrusion 106 located at one end of the sleeve, and a cut out receptacle 108 at the other end of the sleeve. The receptacle can engage the protrusion to form a circular sleeve. The protrusion can be of any geometrical shape, preferably circular. The protrusion can be rigid in structure. Alternately, the protrusion can be collapsible or pop-up, however, its shape can be deformed under use.

The receptacle 108 is complementary in shape to the protrusion 106. The protrusion 106 has a pre-determined height and is in the shape of a circular ring of a certain width with an inner and outer circumference. The circumference of the receptacle 108 is substantially the same as the outer circumference of the protrusion 106.

The protrusion 106 has an inner and outer wall (donut shaped). The position of the protrusion 106 on the sleeve may be fixed. On the other end of the sleeve is a circular cut out which can fit around the outer wall of the ring shaped protrusion in a secure manner in order to provide a functional useable circular sleeve. It is contemplated that in other embodiments of the sleeve, the clasp mechanism may include protrusions and receptacles of other shapes, or comprise protrusions and receptacles of a plurality of shapes in the same sleeve. The sleeve may also have a clasp mechanism comprising multiple protrusions of same or different shapes and sizes to fit one or more receptacles present at the other end to allow variation in the circumference of the circularized sleeve. In an embodiment, the protrusion may have a lip portion on the outside wall or an upper portion.

It should, however, be appreciated that the sleeve can also have any other suitable engagement mechanism for engaging/coupling the two ends of the open strip 100, wherein for instance, it can have a hook based arrangement, latch based configuration, magnet based arrangement, and therefore any other coupling mechanism is well within the scope of the present invention.

The sleeve can be of various colors and shapes. The strip can be rectangular or elliptical in shape as defined in that the length of the sleeve along the horizontal axis is more than the length of the sleeve along the vertical axis. In an exemplary embodiment, the sleeve is rectangular with curved ends and edges.

The outer 102 and inner 104 wall surfaces of the sleeve are textured. Textured surface provides tactile response to the hand and also grip to avoid slipping. For instance, the outer wall of the sleeve has a coarser texture than the inner wall of the sleeve. The textured surface can be due to patterned or randomly arranged grooves or dimples. The dimples can be raised or recessed from the surface of the outer or inner wall of the sleeve. The texture may comprise both grooves and dimples. The grooves or dimples can be of different shapes and sizes. The sleeve may have one more multiple types of grooves, dimples, or both.

The sleeve can be used for insulating the hands of a user while holding the sidewall of a hot or cold beverage cup. In use, the sleeve in strip form can be wrapped around the beverage cup and the clasp mechanism be engaged. This involves inserting the protrusion through the receptacle and pushing down on the upper surface of the protrusion so that its lip extends outward from the outer wall surface and the protrusion is securely held within the receptacle. The sleeve also facilitates a comfortable grip/hold.

The sleeve is substantially thermally insulating. In another embodiment, the sleeve can be electrically insulating.

The sleeve further comprises a plurality of secondary cut outs 110. In an embodiment, the secondary cut outs can be of different shapes and sizes. In one embodiment, the secondary cut outs can facilitate the use of the sleeve as a wire organizer. In another embodiment, the secondary cut outs can alternatively facilitate heat exchange. In yet another embodiment, the secondary cut outs can function as key chain holders. In another embodiment, the secondary cut outs can be utilized to attach personal belongings. In an embodiment, the secondary cut outs pattern can be user customized. In a further exemplary embodiment, the secondary cut outs are user interactive. In an embodiment of user interactive cut outs, the user can use the sleeve as a stencil to doodle on paper or on a 3D surface. It is contemplated that the sleeve in unclasped form can be laid flat on paper and the secondary cut outs can be used as a stencil for doodling. The secondary cut outs can be of different shapes and sizes. It is contemplated that doodling can be done on a 3D surface, such as surface of a beverage cup while the sleeve is positioned around the beverage container, such as, a paper cup. In another embodiment, the secondary cut outs can be used to play a game of tic-tac-toe.

In an embodiment of the present invention, there is provided a sleeve as described herein, wherein said sleeve design or production can be customized prior to user application.

While the foregoing describes various embodiments of the invention, other and further embodiments of the invention may be devised without departing from the basic scope thereof. The invention is not limited to the described embodiments, versions or examples, which are included to enable a person having ordinary skill in the art to make and use the invention when combined with information and knowledge available to the person having ordinary skill in the art.

EXAMPLES

Figure 1B:
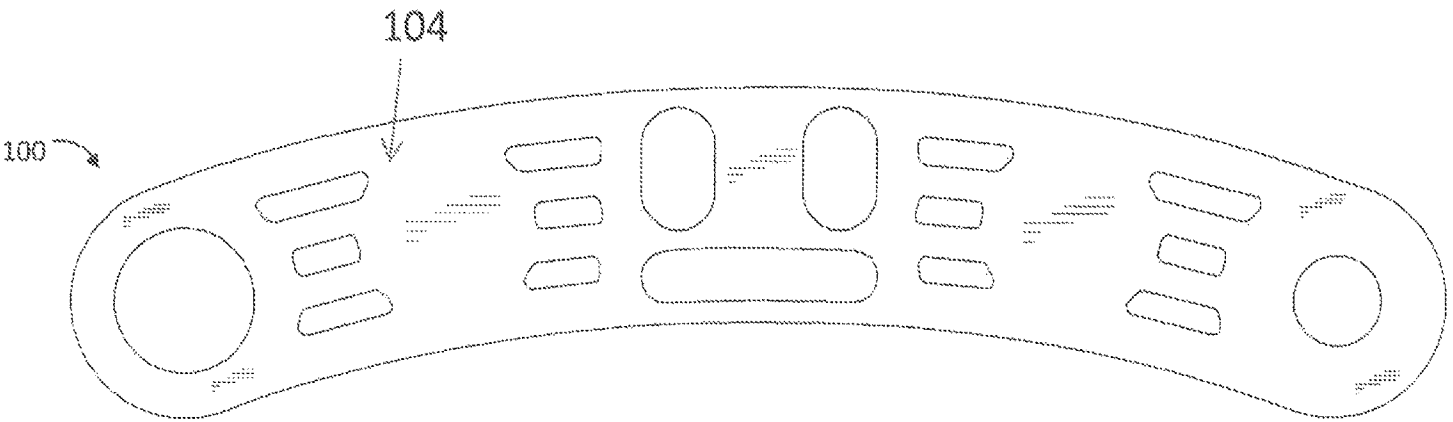
Figure 2:
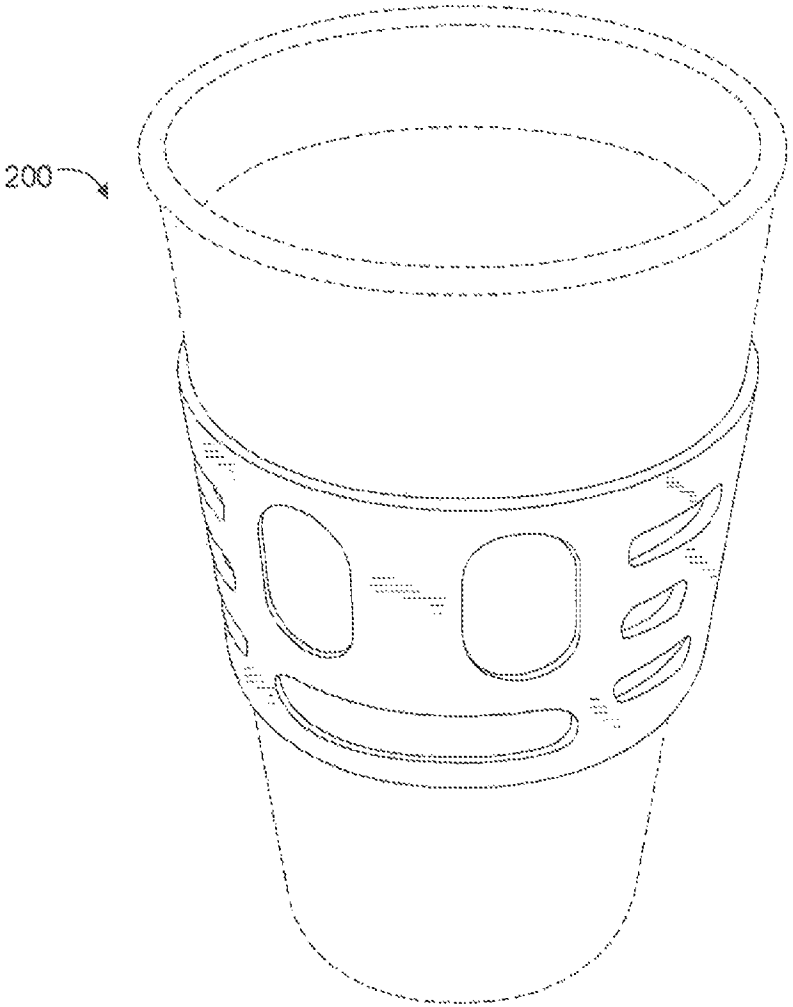
FIG. 2 illustrates a sleeve around a beverage cup in accordance with an embodiment.

In an exemplary illustration, as shown in FIGS. 1A and 1B, there is provided an insulating sleeve 100 which is in the form of a strip. The strip has a front or inner wall surface 104 and a second or an outer wall surface 102. The strip includes a protrusion 106 proximal to one end of the sleeve and forms one component of a sleeve clasp mechanism. The strip 100 further includes a receptacle 104 proximal to a distal end. The receptacle extends from the inner to the outer wall surface. The receptacle form a second component of the clasp mechanism.

FIG. 2 shows a view 200 of the sleeve around a beverage cup. The surface of the walls of the sleeve can be textured to provide tactile feeling, and superior grip. In an exemplary arrangement, the texture of the outside wall is coarser than the inner wall.

Figure 3B:
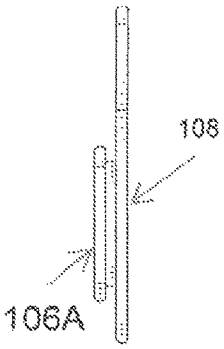
FIG. 3B illustrates a close-up view of a protrusion having an upper lip portion in accordance with an embodiment.
Figure 3A:
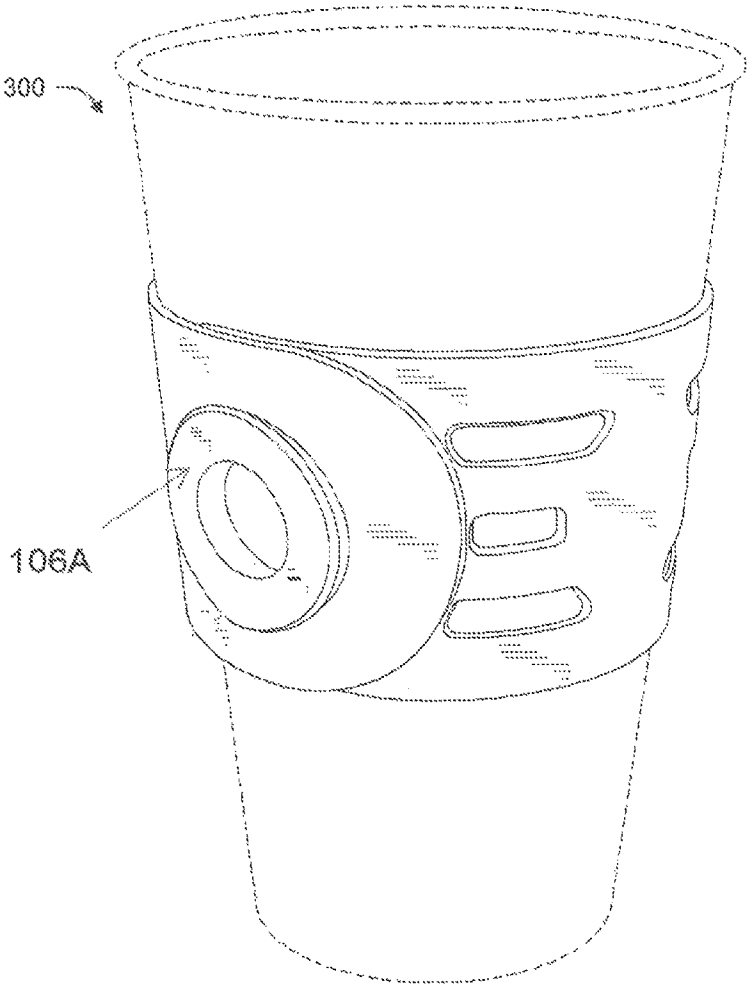
FIG. 3A illustrates a clasp mechanism for the sleeve around a beverage cup in accordance with an embodiment.
Figure 4A:
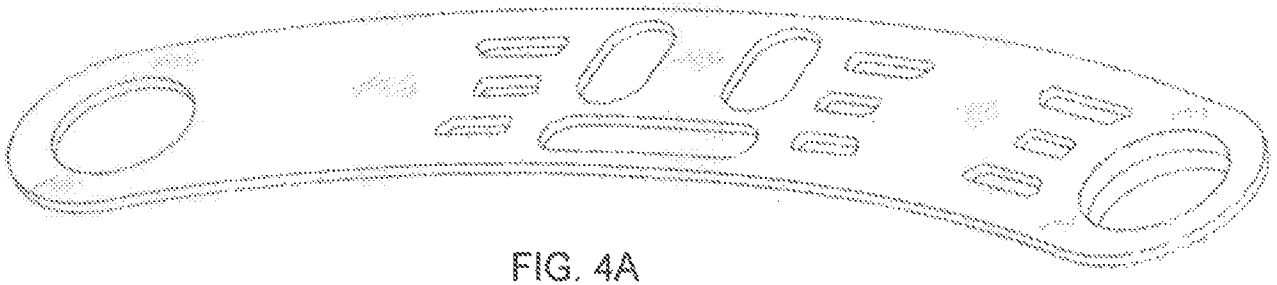
FIGS. 4A-4F illustrate the sleeve with a plurality of various secondary cut outs in accordance with an embodiment.
Figure 4B:
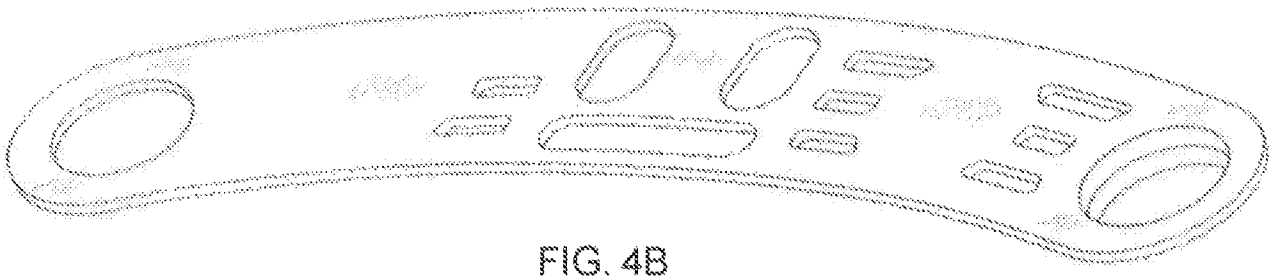
Figure 4C:
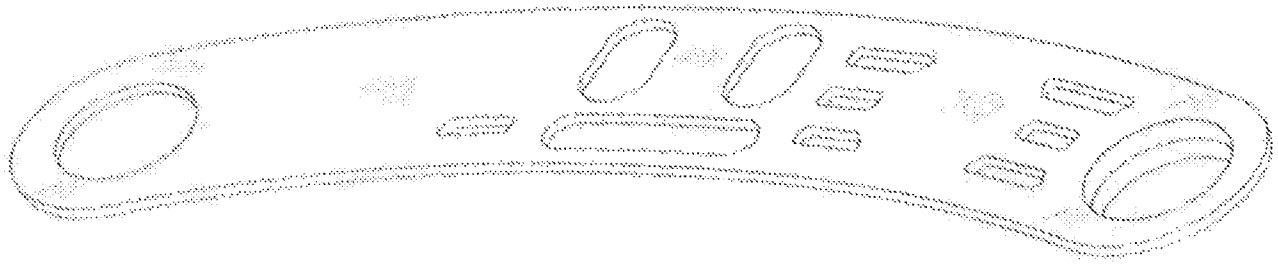
Figure 4D:
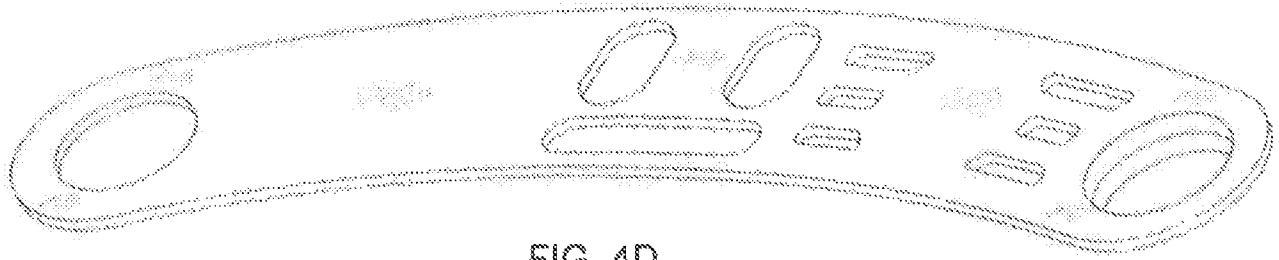
Figure 4E:
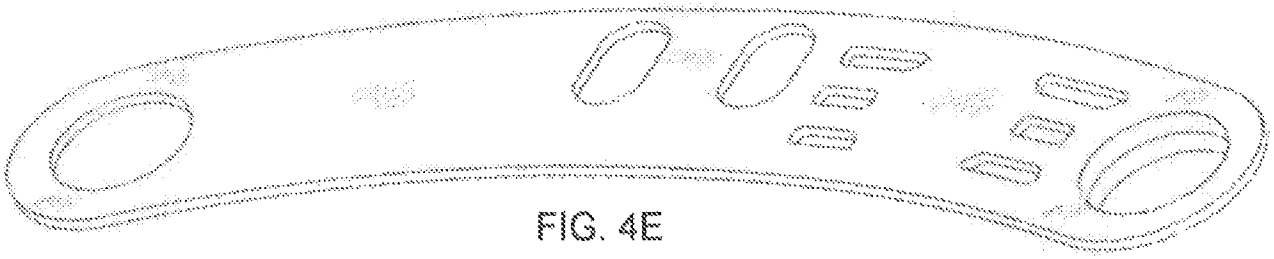
Figure 4F:
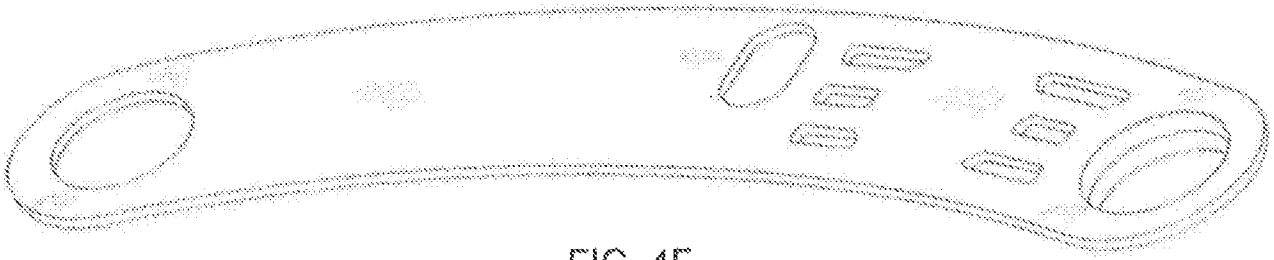

FIG. 3A shows the clasp mechanism in engaged form around a beverage cup such that the strip is transformed to a circular band 300. As shown, an upper surface or outer circumference of the protrusion has a lip portion 106A. The lip portion 106A protrudes out of the outer edge of the receptacle 108 to allow a secure lock.

Referring back FIG. 1A, the strip includes a plurality of secondary cut outs 110. The secondary cut outs 110 can extend from the inner wall surface to the outer wall surface. The secondary cut outs 110 are configured to be user interactive. The secondary cut outs 110 can be used as a stencil for the user to doodle on a 3D surface such as beverage cup surface or on paper.

The sleeve has multiple uses. For instance, the sleeve can be used for the purposes of managing wires/cords. The sleeve may be used to arrange wires, such as those found in entertainment center, or workstation. In one utility, the sleeve can be used in strip form where the clasp is not engaged and wires can be passed through the cut outs. In another utility, the sleeve can be used in circularized form where the clasp is engaged and wires can be passed through the cut outs, through the middle, or both.

In yet another example, the sleeve can be used as a key chain. In one utility, the secondary cut outs can be used to attach keys.

In another example, the sleeve can be used as a bag tag. In another example, the sleeve can be used as a wrist band. The sleeve as a wrist band can be used as a template for customization. In another example, the secondary cut outs of the sleeve can be used to play a tic-tac-toe game.

FIGS. 4A-4F illustrates exemplary representation of how different types of cut-outs can be formed on the proposed strip/sleeve, wherein it should be appreciated that these representations are purely exemplary in nature and any other cutout can be formed in the proposed sleeve.

It can be appreciated by a person skilled in the art that the cut outs can be customized with different cut outs. The purpose of the current disclosure is to provide a 100% compostable sleeve which is reusable and thermally insulating. Advantageously, it is also electrically insulating. The sleeve further essentially comprises cut outs in various shapes and sizes, which are user interactive, and fashionable. The user interactive cut outs make the sleeve an attractive option for users and provides a uniquely different sleeve, not available in the market currently.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While the embodiments of the sleeve are described in terms of "comprising," "containing," or "including" various components or steps, the embodiments also can "consist essentially of" or "consist of" the various components and steps. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification, the definitions that are consistent with this specification should be adopted.

I claim:

1. A sleeve for an object, comprising:

in an open configuration, an elongate strip having an inner wall surface and an outer opposed wall surface, wherein the inner wall surface is configured to contact the object;

the strip further comprising a clasp mechanism, comprising:

at least one protrusion extending radially outward from the outer wall surface, wherein the protrusion is located at a proximal marginal end of the outer wall surface;

at least one indented receptacle located at a distal marginal end of the outer wall surface, wherein the receptacle extends between the inner and outer wall surfaces, wherein the strip includes a plurality of secondary cut outs extending between the inner and outer wall surfaces, wherein each of the secondary cut outs is spaced at a pre-determined distance between the protrusion and the receptacle, wherein at least one pair of the secondary cut outs is a mirror image of each other, wherein the secondary cut outs are selected from a group consisting of logos, letters, numbers, geometric shapes, patterns, cartoon images, animal images, bird images and human images, and wherein in a closed configuration, the receptacle is adapted to securably receive and restrain the protrusion therein.

2. The sleeve according to claim 1, wherein in the closed configuration, the strip forms a band around a circumference of the object.

3. The sleeve according to claim 1, wherein the shape of the protrusion is selected from a group consisting of a circle, an oval, a square and a rectangle.

4. The sleeve according to claim 1, wherein the protrusion is a circular ring.

5. The sleeve according to claim 4, wherein an upper surface of the protrusion has a lip portion.

6. The sleeve according to claim 4, wherein the protrusion has a central opening that extends between the inner and outer wall surfaces.

7. The sleeve according to claim 4, wherein the receptacle is complementary in shape to the protrusion.

8. The sleeve according to claim 1, wherein the receptacle is a cut out that extends between the inner and outer wall surfaces.

9. The sleeve according to claim 1, wherein the inner and outer wall surfaces are textured.

10. The sleeve according to claim 1, wherein the object is a beverage container.

11. The sleeve according to claim 1, wherein the sleeve is a biodegradable sleeve.

12. The sleeve according to claim 1, wherein the sleeve is a reusable sleeve.

13. The sleeve according to claim 1, wherein the sleeve is substantially completely compostable.

14. The sleeve according to claim 1, wherein the sleeve is made of a recycled material.

15. The sleeve according to claim 1, wherein the sleeve is an insulating sleeve.

16. A sleeve for an object comprising:

in an open configuration, an elongate strip having an inner wall surface and an outer opposed wall surface, wherein the inner wall surface is configured to contact the object;

the strip further comprising a clasp mechanism, comprising:

at least one protrusion extending radially outward from the outer wall surface, wherein the protrusion is located at a proximal marginal end of the outer wall surface;

at least one indented receptacle located at a distal marginal end of the outer wall surface, wherein the receptacle extends between the inner and outer wall surfaces, wherein in a closed configuration, the receptacle is adapted to securably receive and restrain the protrusion therein, and wherein the sleeve is made of a polymeric resin material comprising: a starch component; a plasticizer; a thermoplastic polyester based resin; and an albumin.

17. The sleeve according to claim 1, wherein the object is a cord.

* * * * *